US005380192A

United States Patent [19]

Hamos

[11] Patent Number: 5,380,192

[45] Date of Patent: Jan. 10, 1995

[54] HIGH-REFLECTIVITY POROUS BLUE-FLAME GAS BURNER

[75] Inventor: Robert E. Hamos, Simi Valley, Calif.

[73] Assignee: Teledyne Industries, Inc., Los Angeles, Calif.

[21] Appl. No.: 96,280

[22] Filed: Jul. 26, 1993

[51] Int. Cl.[6] ..... F23D 3/40

[52] U.S. Cl. ..... 431/7; 431/328; 431/329

[58] Field of Search ..... 431/328, 329, 10

[56] References Cited

U.S. PATENT DOCUMENTS

| | | | |
|---|---|---|---|
| 2,658,742 | 11/1953 | Suter et al. | 431/328 |
| 3,173,470 | 3/1965 | Wright | 158/99 |
| 4,270,896 | 6/1981 | Polinski et al. | 431/328 |
| 4,332,547 | 6/1982 | MacDonald | 431/329 |
| 4,850,862 | 7/1989 | Bjerklie | 432/182 |
| 4,861,261 | 8/1989 | Krieger | 431/1 |
| 4,878,837 | 11/1989 | Otto | 431/328 |
| 4,890,601 | 1/1990 | Potter | 126/512 |
| 4,895,513 | 1/1950 | Subherwal | 431/328 |
| 4,977,111 | 12/1990 | Tong et al. | 501/95 |
| 5,088,919 | 2/1992 | De Bruyne et al. | 431/328 |
| 5,183,401 | 2/1993 | Dalla Betta et al. | 431/328 |
| 5,205,731 | 4/1993 | Reuther et al. | 431/328 |

FOREIGN PATENT DOCUMENTS 0157432 10/1985 European Pat. Off. .

*Primary Examiner*—Carroll B. Dority

*Attorney, Agent, or Firm*—Benoit Law Corporation

[57] ABSTRACT

The reflectivity of a porous burner matrix is enhanced in order to enhance burner performance, capacity and capability. More specifically, a porous matrix is coated with a layer of a material, such as gold, having a higher reflectivity than the porous matrix by itself, and gas-flow pores of the porous matrix are preserved in that layer. A burner has a porous matrix and a porous coating on that porous matrix including a porous layer of a material, such as gold, having a higher reflectivity than the porous matrix by itself.

24 Claims, 2 Drawing Sheets

HIGH-REFLECTIVITY POROUS BLUE-FLAME GAS BURNER

FIELD OF THE INVENTION

The present invention relates to gas burners, their method of making and their method of use, and to the improved combustion of natural gas, propane and other gaseous fuels by the use of an innovative burner technology.

BACKGROUND OF THE INVENTION

U.S. Pat. No. 5,205,731 by James J. Reuther and Robert D. Litt, issued Apr. 27, 1993 to Battelle Memorial Institute, discloses a nested-fiber gas burner characterized by a certain aspect ratio of the fibers.

European Patent Application 0 157 432, by Shell Internationale Research Maatschappij B. V., Inventors: D. A. C. McCausland et al, entitled Radiant Surface Combustion Burner, and published Oct. 9, 1985, discloses sintered burner elements of non-woven steel fibers containing chromium and aluminum.

A tutorial on porous radiant burners is contained in U.S. Pat. No. 4,977,111, by Timothy W. Tong et al, issued Dec. 11, 1990 for Porous Radiant Burners Having Increased Radiant Output.

Processes of making heat-resistant burner combustion elements are disclosed in U.S. Pat. No. 4,895,513, by Bodh R. Subherwal, issued Jan. 23, 1990 for Heat Resistant Combustion Element, in U.S. Pat. No. 4,878,837, by Nancy M. Otto, issued Nov. 7, 1989 for Infrared Burner and in U.S. Pat. No. 5,088,919, by Roger De Bruyne et al, issued Feb. 18, 1992 for Burner Membrane.

Reference may also be had to U.S. Pat. No. 3,173,470 by J. S. Wright, issued Mar. 16, 1965 for Gas-Fueled Radiant Heater, U.S. Pat. No. 4,850,862, by John W. Bjerklie, issued Jul. 25, 1989 for Porous Body Combustor/Regenerator, U.S. Pat. No. 4,861,261, by Kurt Krieger, issued Aug. 29, 1989 for Method of Operating a Gas-Infrared Radiator, and the Gas-Infrared Radiator, U.S. Pat. No. 4,890,601, by Barry C. Potter, issued Jan. 2, 1990 for Gas Burner.

All and each of the patents listed in this Background of the Invention are herewith incorporated by reference herein.

SUMMARY OF THE INVENTION

The subject invention enhances the reflectivity of a porous burner matrix in order to enhance burner performance, capacity and capability.

From one aspect thereof, the invention resides in a method of providing a gas burner system, and, more specifically, resides in providing a porous matrix having a burner surface where combustion takes place, and coating that porous matrix across said burner surface with a layer of a material, such as gold, having a higher reflectivity than the porous matrix by itself, and preserving gas-flow pores of the porous matrix by extending said gas-flow pores through said layer across said burner surface.

From a related aspect thereof, the invention resides in a gas burner system, and, more specifically, in the improvement comprising, in combination, a burner comprising a porous matrix having a burner surface where combustion takes place, and a porous coating on that porous matrix across said burner surface including a porous layer of a material, such as gold, having a higher reflectivity than the porous matrix by itself with gas-flow pores extending through said porous matrix and said porous layer across said burner surface.

Further aspects and embodiments of the invention will become apparent in the further course of this disclosure.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
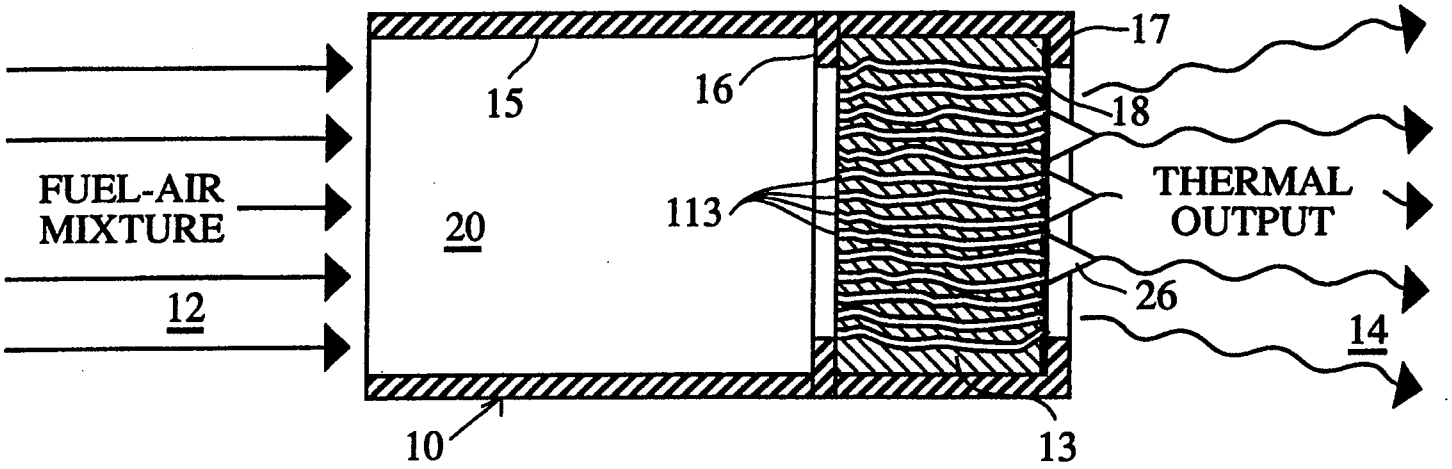
FIG. 1 is a longitudinal section through a burner with a high-reflectivity coated porous burner according to an embodiment of the invention.

In practice, gas burners, such as shown at 10 in FIG. 1, are operated by introducing a premixed gaseous fuel-air mixture 12 into a non-combustible nested-fiber or other porous matrix 13. By adjusting the fuel/air ratio and the gas flow rate, combustion in the past was stabilized inside the porous matrix and the heat from the burning gas warmed the porous matrix via convection. The porous matrix, in turn, radiated thermal energy 14 away from that matrix 13 to supply heat to a desired heat exchanger or heat load.

The burner 10 is shown with a cylindrical or rectangular burner body 15 in which the nested-fiber matrix 13 is mounted, such as by rings or flanges 16 and 17, for example. In this or any other manner, the gas burner system or burner 10 is provided with a chamber 20 for receiving a combustible gas/air mixture 12, and that chamber is closed with the porous matrix 13. Accordingly, the burner 10 includes a chamber 20 for receiving a combustible gas/air mixture 12 on one side of the nested-fiber matrix 13 whereby that combustible gas/air mixture can penetrate that porous matrix. The expression "on one side" in this sentence is intended to be sufficiently broad to encompass the concept of "below" and "above", since the burner 20 not only may face sideways, but upward and downward in various applications of utility.

According to the subject invention, the burner has a coating 18 on the porous matrix 13 including a layer 19 having a higher reflectivity than the porous matrix 13 by itself. In other words, the layer 19 has higher reflectivity than the porous matrix 13 per se. The layer 19 preferably is a layer of gold, but suitable materials include copper and chromium, or alloys thereof, such as gold and copper or chromium carbide.

The layer 19 may be compound, such as a gold and/or copper layer on chromium carbide. Of course, any material, alloy or compound selected will be selected for high reflectivity and durability on the burner in the presence of flames thereon.

Figure 2:
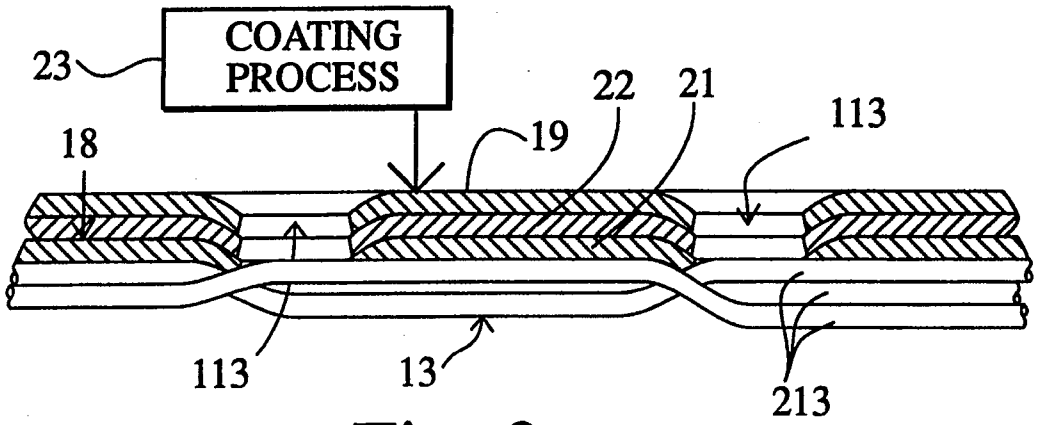
FIG. 2 is a cross-section, on an enlarged scale, through a multilayer coating on top fibers of a nested-fiber matrix according to an embodiment of the invention.

The matrix 13 has pores 113 for a flow of the gas or fuel-air mixture 12 therethrough. In reality, the pores 113 are much more intricate and random than it was possible to show in the drawings. The present invention preserves those pores 113. As seen in the drawings, the porous matrix 13 has a burner surface where combustion 26 takes place and is coated across such burner surface with a coating 18 or with a layer 19. The gas-flow pores 113 are extended or extend through the porous matrix 13 and the coating 18 and layer 19 across the burner surface. In the embodiments of FIGS. 1 and 2 the coating 18 and its layers including top layer 19 are themselves porous. The chamber 20 for receiving the combustible gas/air or fuel-air mixture 12 is on a side of the porous matrix 12 opposite its burner surface at the coating 18 or layer 19.

By way of example, porous burner elements of the type shown in the above mentioned U.S. Pat. Nos. 3,173,470, 4,878,837, 4,895,513, 4,977,111, 5,088,919 and 5,205,731, incorporated by reference herein, and in the above mentioned European Patent Application 0 157 432, may be used as a matrix 13. In the latter two cases, fibers 213 may be randomly deposited in a mold, heated and sintered to leave random pores 113 in a nested-fiber burner matrix at 13.

FIG. 2 on an enlarged scale shows a top section of nested-fiber matrix 13, having top fibers 213 provided with a coating 18. If that coating is only gold or another high-reflectivity material, then that coating 18 may in fact be the high-reflectivity layer 19 directly on the top fibers 213. However, with many matrix materials, the high-reflectivity material 19 typically will not by itself stick on the fibers 213 or other porous matrix 13 sufficiently for burner purposes. Accordingly, if pursuant to a preferred embodiment of the invention, the coating 18 includes on the nested-fiber or porous matrix 13 a material being more heat resistant than that nested-fiber matrix 13, then the layer 19 is the top coating over that material.

Similarly, if the coating 18 includes an anticorrosive material as more fully disclosed below, then the high-reflectivity layer 19 is a top coating over that anticorrosive material.

By way of example, the coating 18 may include on the nested-fiber or other porous matrix 13 a layer 21 of a material being more heat resistant than that nested-fiber matrix 13, and a layer 22 of anticorrosive material on that more heat resistant material, and the high-reflectivity layer 19 as the top coating over that anticorrosive material.

According to an embodiment of the invention, the coating includes a layer 21 of material selected from at least one of aluminum oxide, nickel and titanium on the nested-fiber or other porous matrix 13, and the high-reflectivity layer 19 is a top coating over that material. These materials may be alloyed. For example, the nickel may be alloyed with copper, such as 70% Ni and 30% Cu, known as Monel, or as Cupro-Nickel, such as 70% Cu and 30% Ni.

Also according to an embodiment of the invention, the coating includes a material selected from at least one of silver and platinum, such as in a layer 22. The high-reflectivity layer 19 then is a top coating over that material.

Figure 3:
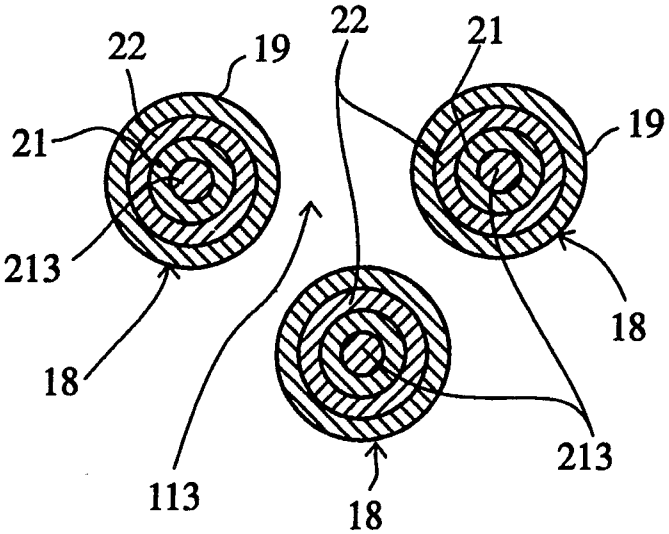
FIG. 3 is a transverse section, on an enlarged scale, through top fibers of a nested-fiber matrix according to an alternative embodiment of the invention.

According to the embodiment of the invention shown in FIGS. 2 and 3, the coating 18 includes a layer 21 of a first material selected from at least one of aluminum oxide, nickel and titanium on the nested-fiber or other porous matrix 13 or fibers 213, and a layer 22 of a second material selected from at least one of silver and platinum on that first material or layer 21, and the high-reflectivity layer 19 as the top coating over that second material or layer 22.

The high-reflectivity layer 19 preferably is a layer of gold. The nested-fiber matrix may be of stainless steel fibers, such as at 213. These fibers may be coated with zirconium or may be made of zirconium instead, but no limitation to any particular material is intended hereby.

The box 23 in FIG. 2 is indicative of processes for providing the coating or coatings 18. For instance, conventional processes may be employed for coating the nested-fiber or other porous matrix 13 or its fibers 213 with the material or layer 21 being more heat resistant than the nested-fiber matrix, for coating that material with an anticorrosive material or layer 22, and for applying the high-reflectivity layer 19 of gold, for instance, as a top coating over that anticorrosive material.

By way of example, electroplating, electroless plating, evaporation, vapor deposition and/or sputtering may be employed for coating the porous matrix 13 or matrix fibers 213 with materials 21, 22, and 19. Such coating processes are well known, and sputtering in an ion plasma assisted by a magnetic field is presently preferred as providing highly adherent coatings.

In practice, the coating 18 may be established after the nested-fiber or other porous matrix has been made, or even after such matrix 13 has been installed in the burner body 15. However, according to an alternative embodiment illustrated in FIG. 3, fibers 213 for the matrix 13 may be provided with the coating 18 or layers 21, 22 and 19, in that order. In either case, the formation and coating of the nested-fiber or other porous matrix leaves pores or interstices 113 through which the fuel-air mixture flows for ignition.

Figure 5:
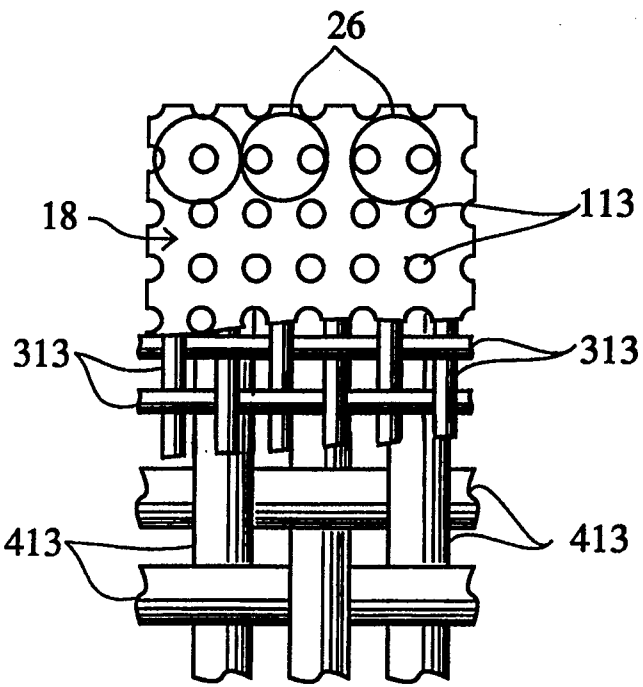
FIG. 5 is a top view of the coated multi-layer woven matrix according to FIG. 4, with the top coating partially pealed away and the top woven layer partially removed for a showing of the matrix infrastructure.
Figure 4:
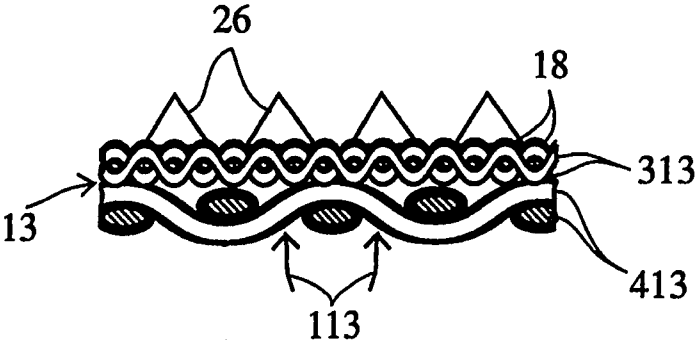
FIG. 4 is a cross-section, on an enlarged scale, of a coated multi-layer woven matrix according to a further embodiment of the invention.

FIGS. 4 and 5 show a further embodiment of the invention. From one aspect thereof, FIGS. 4 and 5 broadly stand for embodiments wherein the porous matrix 13 is made of crossed fibers or filaments 313, 413 of a heat-resistant material, such as stainless steel, tungsten or zirconium.

According to the preferred embodiment explicitly illustrated in FIGS. 4 and 5, the matrix is woven or comprises a woven structure. By way of presently preferred example, each woven structure has a woof and a warp of filaments 313 or 413. For instance, filaments seen horizontally in FIG. 5 may be a woof crossing a warp of filaments shown vertically in FIG. 5.

The top fabric or woven structure may be coated, such as to provide the above mentioned multi-layer coating 18 on top of the woven burner structure. The description of the box 23 shown in FIG. 2 may be referred to in this respect. Alternatively, the filaments 313, for instance, may be coated as in FIG. 3 prior to weaving.

In either case, the desired gas flow pores 113 are provided and preserved. As indicated by the elliptical or depressed cross-section of the filaments 313 and 413, each woven structure or fabric may be squashed or otherwise depressed until pores 113 of the desired size are provided for optimum flow of the gas/air mixture and blue flame combustion.

Thicker or coarser filaments 413 provide a coarser fabric than the finer filaments 313. The coarser fabric may serve as a substrate for the finer fabric. In that case, it is the finer fabric composed of woven filaments 313 that is provided with the coating 18.

Conversely, the thicker filaments 413 of the coarser fabric may be coated, such as shown at 23 in FIG. 2 or as shown in FIG. 3, in which case the finer fabric with its thinner filaments 313 serves as a substrate of the coated coarser fabric and at the same time restricts gas flow through its smaller interstices between its woof and warp.

The coated woven or cross-filament matrix of FIGS. 4 and 5 may be installed in the burner shown in FIG. 1 as the coated matrix 13 with highly reflective outer surface at 18.

Unlike prior-art burners oriented in terms of radiant burner technology, the burner according to embodiments of the subject invention preferably is oriented in terms of a blue-flame-issuing burner. By way of example, FIGS. 1, 4 and 5 show triangles or cones 26 indicating blue flames issuing from the burner matrix 13 on the highly reflective surface of the coating 18 or 19, thus providing the thermal output 14. The triangular shapes at 26 illustrate the leading edges at the fuel-air and air interface.

The fuel-air mixture 12 may be applied to the burner with a blower or otherwise at a pressure substantially higher than atmospheric pressure, so that the burner or heater system will operate with 100% primary air and practically no secondary air for high heat output at low contamination. If flames at 26 are still reddish, the air content in the fuel/air mixture can be increased until the flames turn blue, which also lowers the $NO_x$ emission.

The coating 18 with highly reflective surface 19 thus enables a burner operation which not only decreases the thermal exposure of the burner matrix, but which also facilitates generation of the type of blue flame that increases thermal output and decreases $NO_x$ and $CO_2$ emissions.

I claim:

1. In a method of providing a gas burner system, the improvement comprising in combination:

providing a porous matrix having a burner surface where combustion takes place; and coating said porous matrix across said burner surface with a layer having a higher reflectivity than said matrix by itself, and preserving gas-flow pores of said porous matrix by extending said gas-flow pores through said layer across said burner surface.

2. A method as in claim 1, including:

coating said porous matrix with a material being more heat resistant than said porous matrix; and applying said layer as a top coating over said material.

3. A method as in claim 1, including:

coating said porous matrix with an anticorrosive material; and applying said layer as a top coating over said anticorrosive material.

4. A method as in claim 1, including:

coating said porous matrix with a material being more heat resistant than said porous matrix;

coating said material with an anticorrosive material; and applying said layer as a top coating over said anticorrosive material.

5. A method as in claim 1, wherein:

said layer is a layer of gold.

6. A method as in claim 1, including:

coating said porous matrix with a material selected from at least one of aluminum oxide, nickel and titanium; and applying said layer as a top coating over said material.

7. A method as in claim 1, including:

coating said porous matrix with a material selected from at least one of silver and platinum; and applying said layer as a top coating over said material.

8. A method as in claim 1, including:

coating said porous matrix with a first material selected from at least one of aluminum oxide, nickel and titanium;

coating said first material with a second material selected from at least one of silver and platinum; and applying said layer as a top coating over said second material.

9. A method as in claim 1, wherein:

said porous matrix is made by nesting fibers.

10. A method as in claim 1, wherein:

said porous matrix is made of crossed filaments.

11. A method as in claim 1, wherein:

said porous matrix is woven.

12. A method as in claim 1, including:

providing said gas burner system with a chamber for receiving a combustible gas/air mixture; and closing said chamber on a side opposite said burner surface with said porous matrix.

13. In a gas burner system, the improvement comprising in combination:

a burner comprising a porous matrix having a burner surface where combustion takes place; and a porous coating on said porous matrix across said burner surface including a porous layer having a higher reflectivity than said matrix by itself, with gas-flow pores extending through said porous matrix and said porous layer across said burner surface.

14. A system as in claim 13, wherein:

said porous coating includes a material on said porous matrix being more heat resistant than said porous matrix; and said layer is a porous top coating over said material.

15. A system as in claim 13, wherein:

said porous coating includes an anticorrosive material; and said porous layer is a top coating over said anticorrosive material.

16. A system as in claim 13, wherein:

said porous coating includes a material on said porous matrix being more heat resistant than said porous matrix, and an anticorrosive material on said more heat resistant material; and said porous layer is a porous top coating over said anticorrosive material.

17. A system as in claim 13, wherein:

said layer is a layer of gold.

18. A system as in claim 13, wherein:

said coating includes a material selected from at least one of aluminum oxide, nickel and titanium on said porous matrix; and said layer is a top coating over said material.

19. A system as in claim 13, wherein:

said coating includes a material selected from at least one of silver and platinum; and said layer is a top coating over said material.

20. A system as in claim 13, wherein:

said coating includes a first material selected from at least one of aluminum oxide, nickel and titanium on said porous matrix, and a second material selected from at least one of silver and platinum on said first material; and said layer is a top coating over said second material.

21. In a gas burner system, the improvement comprising in combination:

a burner comprising a nested-fiber matrix; and a porous coating on said nested-fiber matrix including a porous layer having a higher reflectivity than said matrix by itself, with gas-flow pores extending through said nested-fiber matrix and said porous layer.

22. A system as in claim 13, wherein:

said porous matrix comprises crossed filaments.

23. A system as in claim 13, including a woven structure as said porous matrix.

24. A system as in claim 13, including:

a chamber for receiving a combustible gas/air mixture on a side of said porous matrix opposite said burner surface whereby said combustible gas/air mixture can penetrate into said porous matrix.

* * * * *